US007546784B1

(12) United States Patent
Yu

(10) Patent No.: US 7,546,784 B1
(45) Date of Patent: Jun. 16, 2009

(54) PLIERS HAVING GREATER HOLDING FORCE

(75) Inventor: Chiu-Ying Yu, Belize (BZ)

(73) Assignee: MH Corporation, Belize (BZ)

( * ) Notice: Subject to any disclaimer, the term of this patent is extended or adjusted under 35 U.S.C. 154(b) by 9 days.

(21) Appl. No.: 11/945,586

(22) Filed: Nov. 27, 2007

(51) Int. Cl.
*B25B 13/28* (2006.01)

(52) U.S. Cl. ..... 81/99; 81/111; 81/186; 81/92; 81/93; 81/94; 81/97

(58) Field of Classification Search ..... 81/99, 81/111, 186, 92–94, 97
See application file for complete search history.

(56) References Cited

U.S. PATENT DOCUMENTS 7,044,030 B2 * 5/2006 Chartier et al. ..... 81/99
7,096,764 B2 * 8/2006 Dong ..... 81/99

* cited by examiner

*Primary Examiner*—Joseph J Hail, III
*Assistant Examiner*—Shantese McDonald
(74) *Attorney, Agent, or Firm*—Banger Shia

(57) ABSTRACT

A pair of pliers include a shank, a fixed jaw locked onto the shank, and a movable jaw pivotally mounted on the shank and movable relative to the fixed jaw. Thus, the first contact point of the locking teeth of the fixed jaw and the second contact point of the first engaging teeth of the first toothed face of the movable jaw have a larger friction with a workpiece by a special angle design of the fixed jaw and the movable jaw to enhance the clamping force of the fixed jaw and the movable jaw on the workpiece, so that the workpiece is clamped by the fixed jaw and the movable jaw exactly and closely to prevent the workpiece from being slipped from the fixed jaw and the movable jaw during operation of the pliers.

4 Claims, 3 Drawing Sheets

PLIERS HAVING GREATER HOLDING FORCE

BACKGROUND OF THE INVENTION

1. Field of the Invention

The present invention relates to a pair of pliers, and more particularly to a pair of pliers for operating a workpiece, such as a pipe, rod and the like.

2. Description of the Related Art

A pair of conventional pliers comprise an elongated shank, a fixed jaw locked onto at least one end of the shank, and a movable jaw pivotally mounted on the at least one end of the shank and movable relative to the fixed jaw. The fixed jaw has a surface provided with a plurality of locking teeth. The movable jaw has a surface provided with a first toothed face and a second toothed face. The first toothed face of the movable jaw is provided with a plurality of first engaging teeth. The second toothed face of the movable jaw is provided with a plurality of second engaging teeth. Thus, a workpiece is clamped between the locking teeth of the fixed jaw, the first engaging teeth of the first toothed face of the movable jaw and the second engaging teeth of the second toothed face of the movable jaw. In such a manner, the movable jaw is movable relative to the fixed jaw to clamp workpieces of different sizes by a pivot action of the movable jaw. However, when the swinging angle of the movable jaw exceeds a determined value, the locking teeth of the fixed jaw, the first engaging teeth of the first toothed face of the movable jaw and the second engaging teeth of the second toothed face of the movable jaw cannot engage the surface of the workpiece efficiently, so that the workpiece easily slips from the fixed jaw and the movable jaw of the pliers, thereby causing inconvenience to the user.

The closest prior art references of which the applicant is aware are disclosed in U.S. Pat. Nos. 2,559,973; 6,026,714; 6,742,419; 7,044,030 and 7,096,764.

SUMMARY OF THE INVENTION

The present invention is to mitigate and/or obviate the disadvantage of the conventional pliers.

The primary objective of the present invention is to provide a pair of pliers having an enhanced friction to prevent from incurring a slip during operation of the pliers.

Another objective of the present invention is to provide a pair of pliers, wherein the first contact point of the locking teeth of the fixed jaw and the second contact point of the first engaging teeth of the first toothed face of the movable jaw have a larger friction with the surface of the workpiece by the special angle design of the fixed jaw and the movable jaw to enhance the clamping force of the fixed jaw and the movable jaw on the surface of the workpiece, so that the workpiece is clamped by the fixed jaw and the movable jaw exactly and closely to prevent the workpiece from being slipped from the fixed jaw and the movable jaw during operation of the pliers.

A further objective of the present invention is to provide a pair of pliers, wherein each of the locking teeth of the fixed jaw, the first engaging teeth and the second engaging teeth of the movable jaw is designed to have an obtuse angle to enhance the strength of the locking teeth, the first engaging teeth and the second engaging teeth.

A further objective of the present invention is to provide a pair of pliers, wherein the first tangent line of the locking teeth of the fixed jaw and a face of a contacting one of the locking teeth of the fixed jaw have an included angle ranged between 37° and 45° to prevent the workpiece from being slipped from the fixed jaw due to a deformation of the workpiece.

In accordance with the present invention, there is provided a pair of pliers, comprising an elongated shank, a substantially convex fixed jaw locked onto at least one end of the shank, and a movable jaw pivotally mounted on the at least one end of the shank and movable relative to the fixed jaw. The fixed jaw has a surface provided with a plurality of locking teeth. The movable jaw has a surface provided with a first toothed face and a second toothed face. The first toothed face of the movable jaw is provided with a plurality of first engaging teeth. The second toothed face of the movable jaw is provided with a plurality of second engaging teeth. A workpiece is clamped between the locking teeth of the fixed jaw, the first engaging teeth of the first toothed face of the movable jaw and the second engaging teeth of the second toothed face of the movable jaw. Each of the locking teeth of the fixed jaw has an angle (D) ranged between 90° and 92°. Each of the first engaging teeth of the first toothed face of the movable jaw has an angle (B) ranged between 93° and 97°. Each of the second engaging teeth of the second toothed face of the movable jaw has an angle (B) ranged between 93° and 97°. A line (L1) passing apexes of the first engaging teeth of the first toothed face of the movable jaw and a line (L2) passing apexes of the second engaging teeth of the second toothed face of the movable jaw have an included angle (H) ranged between 134° and 136°. The locking teeth of the fixed jaw and the workpiece have a first contact point (P1) and a first tangent line (L3). The first engaging teeth of the first toothed face of the movable jaw and the workpiece have a second contact point (P2) and a second tangent line (L4). The second engaging teeth of the second toothed face of the movable jaw and the workpiece have a third contact point (P3) and a third tangent line (L5). A line (L6) passing the first contact point (P1) and a center (O) of the workpiece and a line (L8) passing the third contact point (P3) and the center (O) of the workpiece have an included angle (G) ranged between 160° and 176°.

Further benefits and advantages of the present invention will become apparent after a careful reading of the detailed description with appropriate reference to the accompanying drawings.

DETAILED DESCRIPTION OF THE INVENTION

Figure 1:
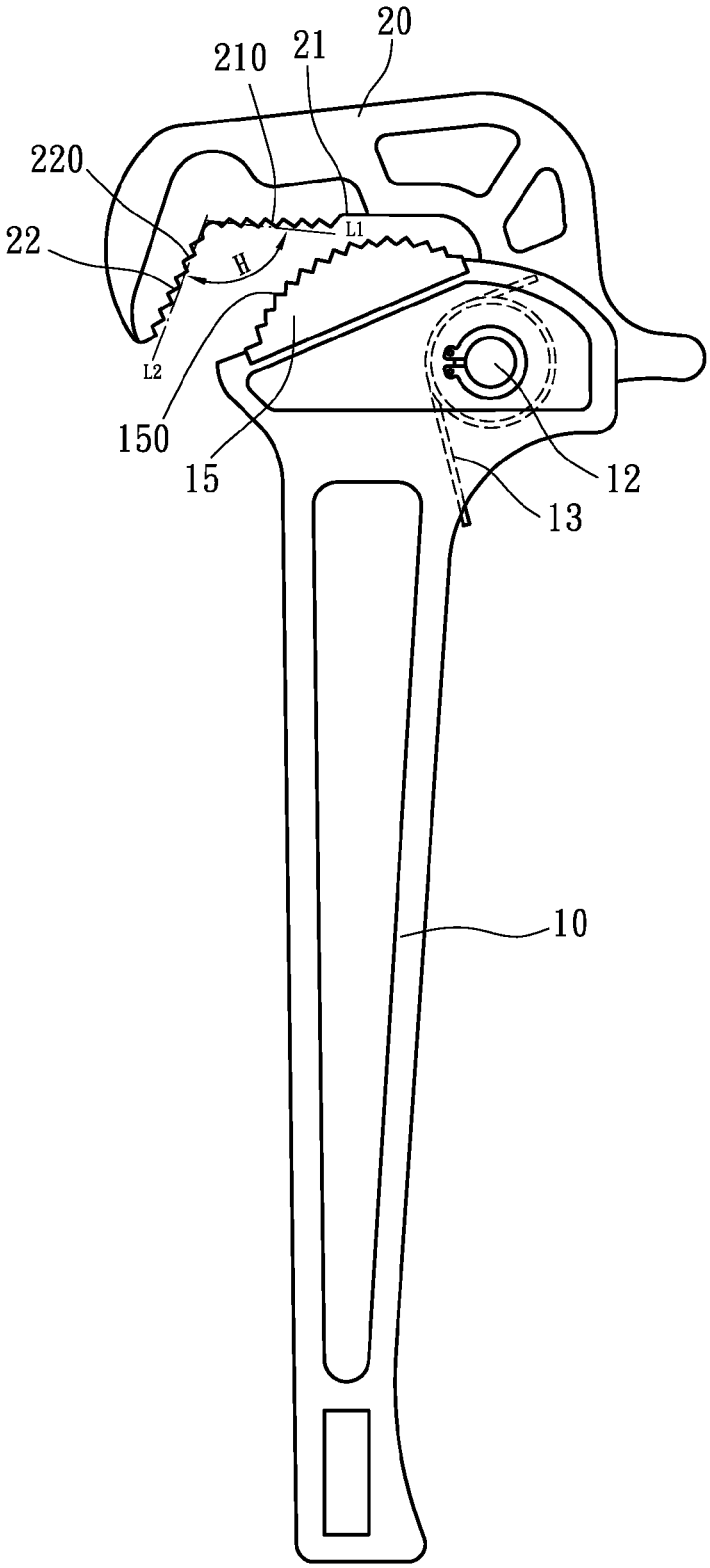
FIG. 1 is a side view of a pair of pliers in accordance with the preferred embodiment of the present invention.

Referring to the drawings and initially to FIG. 1, a pair of pliers in accordance with the preferred embodiment of the present invention comprise an elongated shank 10, a substantially convex fixed jaw 15 locked onto at least one end of the shank 10, a movable jaw 20 pivotally mounted on the at least one end of the shank 10 by a pivot shaft 12 and movable relative to the fixed jaw 15, and a torsion spring 13 mounted on the pivot shaft 12 and having a first end pressing the at least one end of the shank 10 and a second end pressing the movable jaw 20 to move the movable jaw 20 toward the fixed jaw 15 at a normal state. The fixed jaw 15 has a surface provided with a plurality of locking teeth 150. The movable jaw 20 has a surface provided with a first toothed face 21 and a second toothed face 22 which are arranged to form a substantially V-shaped profile. The first toothed face 21 of the movable jaw 20 is provided with a plurality of first engaging teeth 210. The second toothed face 22 of the movable jaw 20 is provided with a plurality of second engaging teeth 220.

Figure 2:
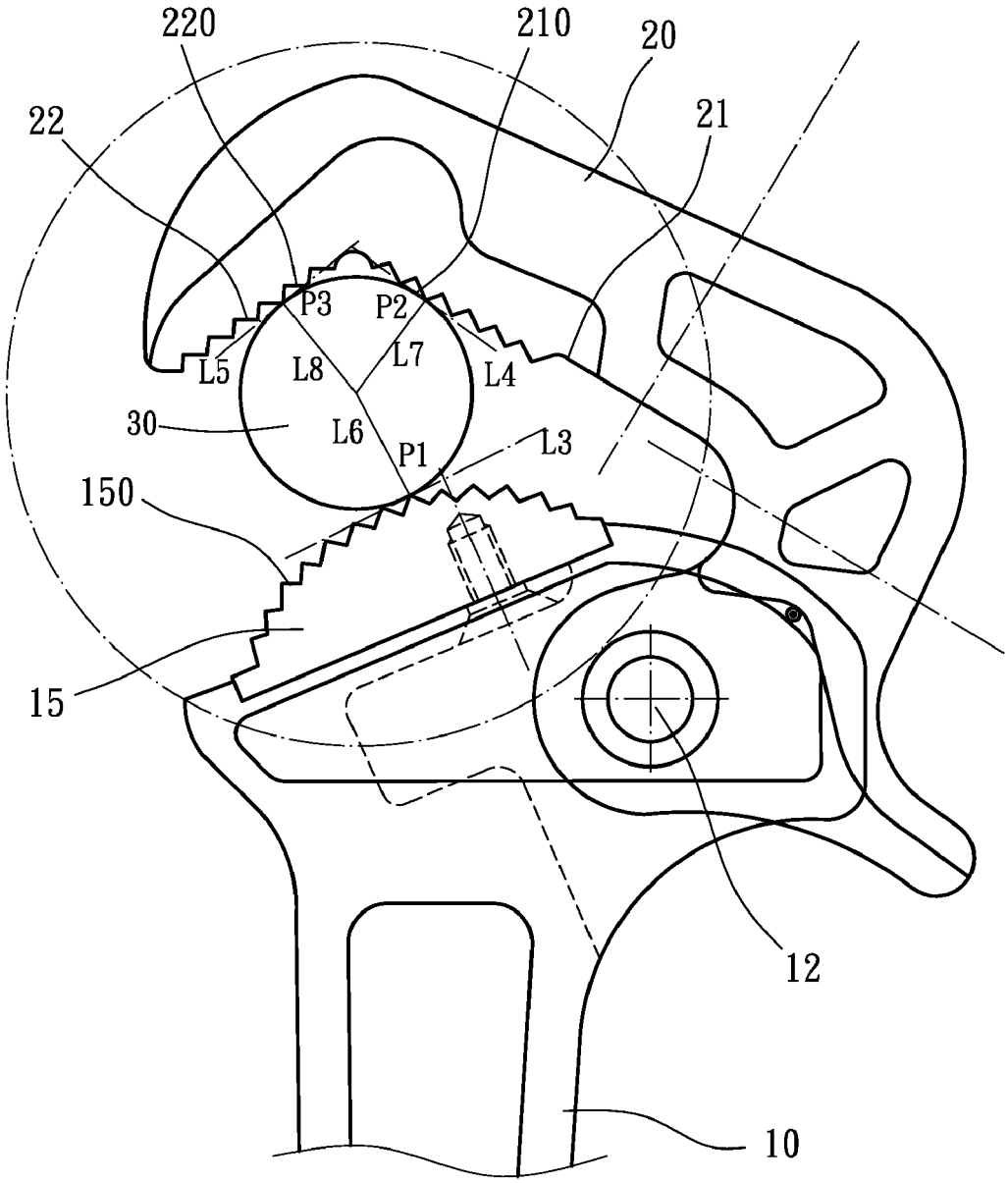
FIG. 2 is a schematic operational view of the pliers as shown in FIG. 1 in use.
Figure 3:
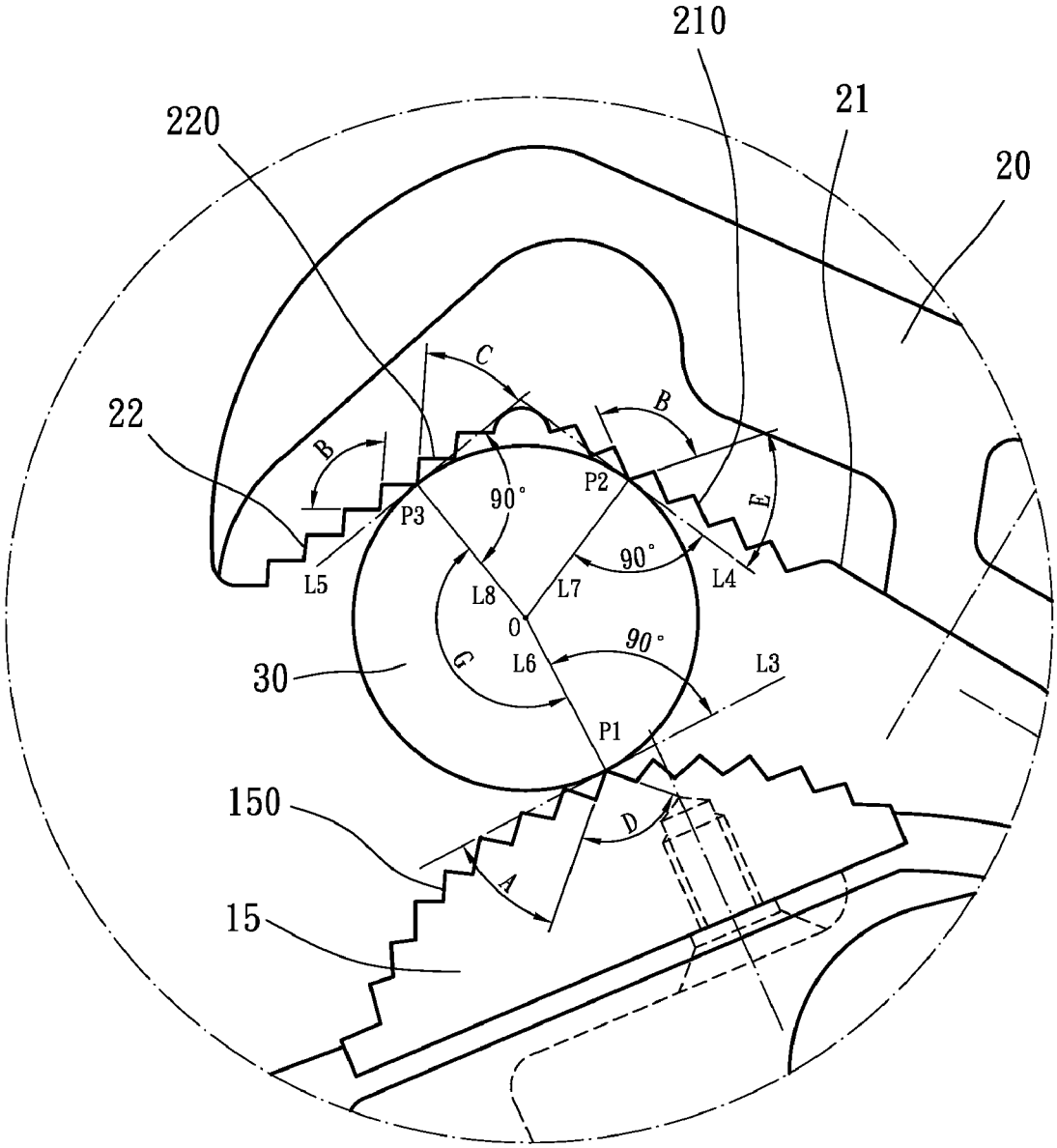
FIG. 3 is a locally enlarged view of the pliers as shown in FIG. 2.

Referring to FIGS. 1-3, when the pliers are used to operate a workpiece 30, such as a pipe, rod and the like, the workpiece 30 is clamped between the locking teeth 150 of the fixed jaw 15, the first engaging teeth 210 of the first toothed face 21 of the movable jaw 20 and the second engaging teeth 220 of the second toothed face 22 of the movable jaw 20. In such a manner, each of the locking teeth 150 of the fixed jaw 15 has an angle (D) ranged between 90° and 92°. Each of the first engaging teeth 210 of the first toothed face 21 of the movable jaw 20 has an angle (B) ranged between 93° and 97°, and each of the second engaging teeth 220 of the second toothed face 22 of the movable jaw 20 also has an angle (B) ranged between 93° and 97°.

A line (L1) passing apexes of the first engaging teeth 210 of the first toothed face 21 of the movable jaw 20 and a line (L2) passing apexes of the second engaging teeth 220 of the second toothed face 22 of the movable jaw 20 have an included angle (H) ranged between 134° and 136°.

In addition, the locking teeth 150 of the fixed jaw 15 and the workpiece 30 have a first contact point (P1) and a first tangent line (L3), the first engaging teeth 210 of the first toothed face 21 of the movable jaw 20 and the workpiece 30 have a second contact point (P2) and a second tangent line (L4), and the second engaging teeth 220 of the second toothed face 22 of the movable jaw 20 and the workpiece 30 have a third contact point (P3) and a third tangent line (L5). A line (L6) passing the first contact point (P1) and a center (O) of the workpiece 30 and a line (L8) passing the third contact point (P3) and the center (O) of the workpiece 30 have an included angle (G) ranged between 160° and 176°. A line (L7) passes the second contact point (P2) and the center (O) of the workpiece 30. The first tangent line (L3) and a face of a contacting one of the locking teeth 150 of the fixed jaw 15 have an included angle (A) ranged between 37° and 45°. The second tangent line (L4) and a face of a contacting one of the first engaging teeth 210 of the first toothed face 21 of the movable jaw 20 have an included angle (E) ranged between 40° and 55°. The third tangent line (L5) and a face of a contacting one of the second engaging teeth 220 of the second toothed face 22 of the movable jaw 20 have an included angle (C) ranged between 45' and 60°.

In practice, the workpiece 30 is clamped by the first contact point (P1) of the locking teeth 150 of the fixed jaw 15, the second contact point (P2) of the first engaging teeth 210 of the first toothed face 21 of the movable jaw 20 and the third contact point (P3) of the second engaging teeth 220 of the second toothed face 22 of the movable jaw 20, so that the workpiece 30 is positioned by the fixed jaw 15 and the movable jaw 20 and is operated by rotation of the shank 10. In such a manner, the first contact point (P1) of the locking teeth 150 of the fixed jaw 15 and the second contact point (P2) of the first engaging teeth 210 of the first toothed face 21 of the movable jaw 20 produce a larger friction with the surface of the workpiece 30 by the special angle design of the fixed jaw 15 and the movable jaw 20 to enhance the clamping force of the fixed jaw 15 and the movable jaw 20 on the surface of the workpiece 30, so that the workpiece 30 is clamped by the fixed jaw 15 and the movable jaw 20 exactly and closely to prevent the workpiece 30 from being slipped from the fixed jaw 15 and the movable jaw 20 during operation of the pliers.

Accordingly, the first contact point (P1) of the locking teeth 150 of the fixed jaw 15 and the second contact point (P2) of the first engaging teeth 210 of the first toothed face 21 of the movable jaw 20 have a larger friction with the surface of the workpiece 30 by the special angle design of the fixed jaw 15 and the movable jaw 20 to enhance the clamping force of the fixed jaw 15 and the movable jaw 20 on the surface of the workpiece 30, so that the workpiece 30 is clamped by the fixed jaw 15 and the movable jaw 20 exactly and closely to prevent the workpiece 30 from being slipped from the fixed jaw 15 and the movable jaw 20 during operation of the pliers. In addition, each of the locking teeth 150 of the fixed jaw 15, the first engaging teeth 210 and the second engaging teeth 220 of the movable jaw 20 is designed to have an obtuse angle to enhance the strength of the locking teeth 150, the first engaging teeth 210 and the second engaging teeth 220. Further, the first tangent line (L3) of the locking teeth 150 of the fixed jaw 15 and a face of a contacting one of the locking teeth 150 of the fixed jaw 15 have an included angle (A) ranged between 37° and 45° to prevent the workpiece 30 from being slipped from the fixed jaw 15 due to a deformation of the workpiece 30.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A pair of pliers, comprising:

an elongated shank;

a substantially convex fixed jaw locked onto at least one end of the shank;

a movable jaw pivotally mounted on the at least one end of the shank and movable relative to the fixed jaw; wherein the fixed jaw has a surface provided with a plurality of locking teeth;

the movable jaw has a surface provided with a first toothed face and a second toothed face;

the first toothed face of the movable jaw is provided with a plurality of first engaging teeth;

the second toothed face of the movable jaw is provided with a plurality of second engaging teeth;

a workpiece is clamped between the locking teeth of the fixed jaw, the first engaging teeth of the first toothed face of the movable jaw and the second engaging teeth of the second toothed face of the movable jaw;

each of the locking teeth of the fixed jaw has an angle (D) ranged between 90° and 92°;

each of the first engaging teeth of the first toothed face of the movable jaw has an angle (B) ranged between 93° and 97°;

each of the second engaging teeth of the second toothed face of the movable jaw has an angle (B) ranged between 93° and 97°;

a line (L1) passing apexes of the first engaging teeth of the first toothed face of the movable jaw and a line (L2) passing apexes of the second engaging teeth of the second toothed face of the movable jaw have an included angle (H) ranged between 134° and 136°;

the apex of one of the locking teeth of the fixed jaw and the workpiece have a first contact point (P1) and a first tangent line (L3);

the apex of one of the first engaging teeth of the first toothed face of the movable jaw and the workpiece have a second contact point (P2) and a second tangent line (L4);

the apex of one of the second engaging teeth of the second toothed face of the movable jaw and the workpiece have a third contact point (P3) and a third tangent line (L5);

a line (L6) passing the first contact point (P1) and a center (O) of the workpiece and a line (L8) passing the third contact point (P3) and the center (O) of the workpiece have an included angle (G) ranged between 160° and 176°;

the first tangent line (L3) and a face of a contacting one of the locking teeth of the fixed jaw have an included angle (A) ranged between 37° and 45° to prevent the workpiece from being slipped from the fixed jaw due to a deformation of the workpiece;

the second tangent line (L4) and a face of a contacting one of the first engaging teeth of the first toothed face of the movable jaw have an included angle (E) ranged between 40° and 55°;

the third tangent line (L5) and a face of a contacting one of the second engaging teeth of the second toothed face of the movable jaw have an included angle (C) ranged between 45° and 60°;

the first contact point (P1) of the locking teeth of the fixed jaw and the second contact point (P2) of the first engaging teeth of the first toothed face of the movable jaw have a larger friction with a surface of the workpiece by a special angle design of the fixed jaw and the movable jaw to enhance a clamping force of the fixed jaw and the movable jaw on the surface of the workpiece, so that the workpiece is clamped by the fixed jaw and the movable jaw exactly and closely;

each of the locking teeth of the fixed jaw, the first engaging teeth and the second engaging teeth of the movable jaw is designed to have an obtuse angle to enhance the strength of the locking teeth, the first engaging teeth and the second engaging teeth.

2. The pliers in accordance with claim 1, wherein the first toothed face and the second toothed face of the movable jaw are arranged to form a substantially V-shaped profile.

3. The pliers in accordance with claim 1, wherein the movable jaw is pivotally mounted on the at least one end of the shank by a pivot shaft.

4. The pliers in accordance with claim 3, further comprising a torsion spring mounted on the pivot shaft and having a first end pressing the at least one end of the shank and a second end pressing the movable jaw to move the movable jaw toward the fixed jaw at a normal state.

* * * * *